United States Patent [19]

Dauvergne

[11] 4,207,840

[45] Jun. 17, 1980

[54] OIL BATH BOILER

[76] Inventor: Hector A. Dauvergne, 419 E. Merle Ct., San Leandro, Calif. 94577

[21] Appl. No.: 942,199

[22] Filed: Sep. 14, 1978

[51] Int. Cl.[2] ..... F22B 1/06

[52] U.S. Cl. ..... 122/31 R

[58] Field of Search ..... 122/31, 32, 35

[56] References Cited

U.S. PATENT DOCUMENTS

| | | | |
|---|---|---|---|
| 42,904 | 5/1864 | True | 122/31 |
| 2,222,575 | 11/1940 | Schutte | 122/31 |
| 3,032,482 | 5/1962 | Shoemaker | 122/31 |
| 3,939,803 | 2/1976 | Meissner et al. | 122/31 |
| 4,084,379 | 4/1978 | Schwartzman | 122/31 |

*Primary Examiner*—Edward G. Favors

*Attorney, Agent, or Firm*—Bielen and Peterson

[57] ABSTRACT

A boiler comprising a pressure vessel containing a volume of oil, a heat exchanger adapted to heat the oil within the pressure vessel and a water injection unit for injecting water into the oil volume and the pressure vessel for generation of steam.

7 Claims, 1 Drawing Figure

OIL BATH BOILER

BACKGROUND OF THE INVENTION

This invention relates to a simple boiler device adapted to generate steam for use in customary steam facilities. Ordinarily, boilers comprise a water system and a heat exchange system which heats the water to produce steam that may be used by auxiliary components in generating power or for heating. The device of this invention utilizes in addition an oil bath medium in order to cause the immediate generation of steam upon demand.

Conventional boiler systems are constructed to continuously generate steam. When the requirement for steam diminishes the boiler must be gradually shut down to diminish the reduction of steam by the reduction of fueling to the associated furnace. Upon an immediate cessation in the requirements for steam, then it is customary to simply vent the unwanted steam in order to maintain the pressure within the boiler at safe operating levels. Subsequently to the venting the fueling of the furnace can be adjusted in order to accomodate the change in demand. In certain situations it may be desirable to have a means for storing heat energy and generating steam only upon the required demand.

SUMMARY OF THE INVENTION

The boiler of this invention utilizes a stored volume of oil to retain the heat from a combustion process for the production of steam upon demand. The boiler utilizes a pressure vessel which is substantially filled with a non-volatile oil. A suitable heat exchanger heats the oil to a temperature that is substantially elevated above the boiling point of water. When a demand for steam arises, an injection unit injects water into the high temperature oil. The water immediately changes to steam which rises above the level of oil in the pressure vessel for use by auxiliary components.

When a fine spray of water is injected into oil the interface between the liquid water and the heat transfer medium, the oil, is substantially greater than is possible in conventional heat exchange systems. Because water is injected as a liquid into the oil, the pump requirements for the injection system are substantially conventional in order to function in the pressure ranges of a conventional boiler system.

The boiler of this invention is designed to function primarily with furnace or fuel systems that are not easily regulated such as wood burning systems since the heat energy generated is stored in the oil prior to or during generation of the steam requirements. Because some of the steam may be contaminated with droplets of oil during the violent steam generation process, it is preferred that the steam system be a closed system in order to prevent venting of contaminated steam to the environment.

These and other features of the oil bath boiler are described in greater detail in the detailed description of the preferred embodiment.

DETAILED DESCRIPTION OF THE PREFERRED EMBODIMENT

Figure 1:
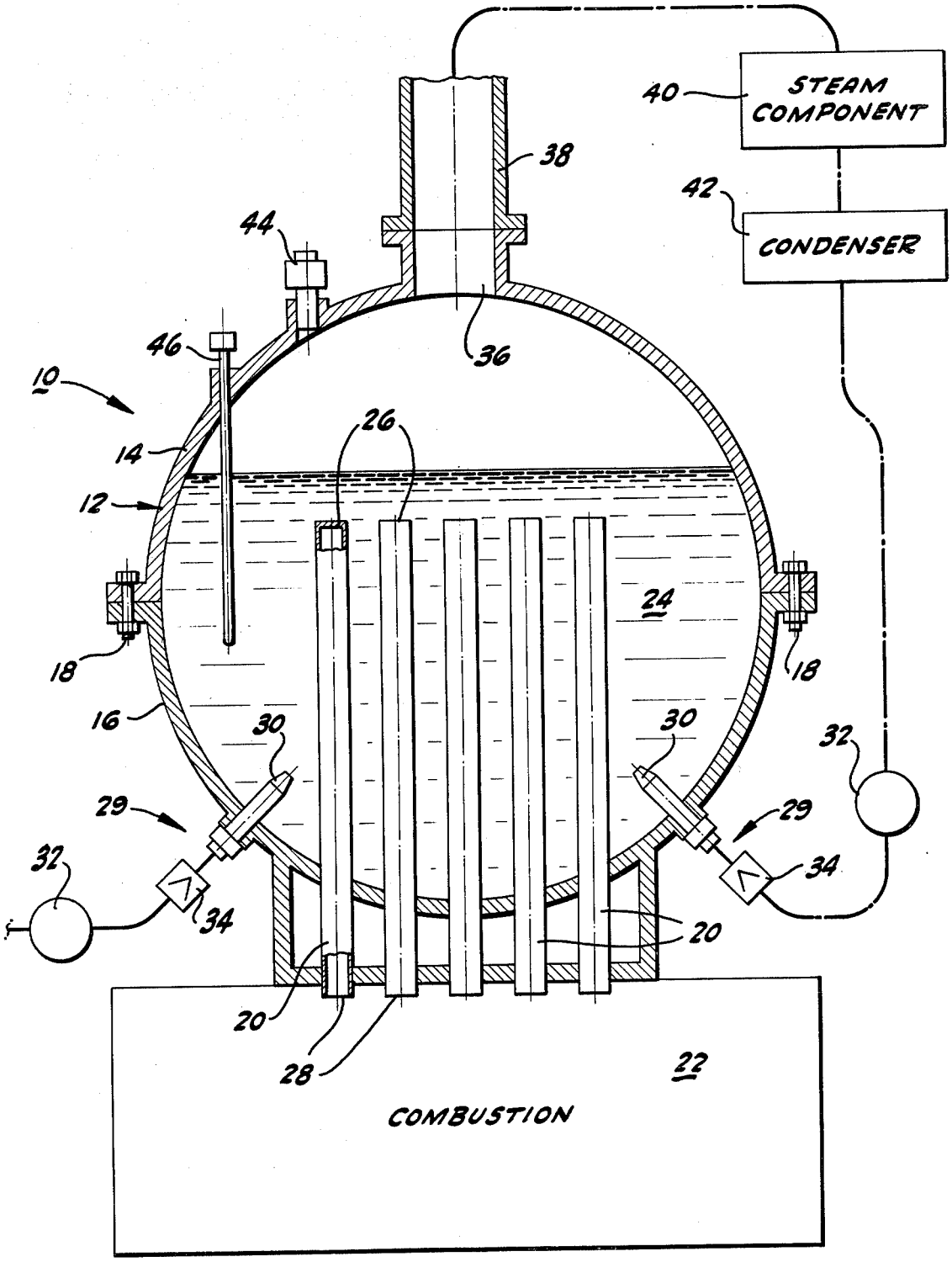
FIG. 1 is a schematic illustration of the oil bath boiler.

Referring to FIG. 1, the oil bath boiler, designated generally by reference 10, is schematically illustrated with a spherical pressure vessel 12 constructed in two hemispherical sections 14 and 16 bolted together by bolts 18 periphery around the interface of the two hemispherical sections. Entering the spherical vessel are a plurality of closed heat exchange tubes 20 which communicate with a combustion source 22. The combustion source 22 may comprise a furnace or a fireplace in which a conventional fuel, usually of a type not easily regulated such as wood, is burned. The spherical vessel and heat exchange tubes 20 are arranged above the combustion source 22 such that normal convection will cause the heated gases within the combustion source to rise into the heat exchange tubes that may alternately be vented.

The spherical vessel 12 is filled with a non-volatile oil 24 to approximately two-thirds the volume of the vessel. The level of oil within the vessel is maintained above the terminating ends 26 of the closed heat exchange tubes 20. The opposite ends 28 of the heat exchange tubes 20 are open and communicate with the combustion source 22. During combustion the temperature of the oil is elevated to a temperature substantially in excess of the boiling point of water. A comfortable operating range for most efficient operation would be between approximately 300° F. and 800° F.

Arranged around the lower portion of the spherical vessel are a plurality of water injection units 28. The water injection units each include a nozzle 30 which penetrates the wall of the pressure vessel, a high pressure pump 32 and a check valve 34. The pump 32 forces water into the pressure vessel through the nozzel 30 wherein the injected water is immediately converted to steam.

Steam is collected in the upper volume of the spherical vessel and is drawn through an outlet 36 to a vertical steam pipe 38. The length of the vertical outlet which is arranged above the spherical vessel is preferably in excess of one foot in order to allow a drainback of any oil droplets carried upwardly by the steam escaping through the outlet 36. The steam is transported to a steam component 40 which may comprise a conventional heat exchange radiator or a small steam turbine. From the steam component the steam from which heat or work is extracted is then passed through a condenser 42 for conversion back to water. The water is then recycled again through the closed loop system. Any oil that may have transported with the steam through the system loop is injected with the water back into the spherical pressure vessel.

The oil bath boiler may be equiped with conventional safety devices such as a safety valve 44 and an oil level detector 46.

The oil bath steam generator of this invention is ideally suited for those environments in which a regular source of heat or power is unavailable, and where the fuel supplies are of the type that are difficult to regulate.

While in the foregoing specification embodiments of the invention have been set forth in considerable detail for the purposes of making a complete disclosure of the invention, it will be apparent to those of ordinary skill in the art that numerous changes may be made in such details without departing from the spirit and principals of the invention.

What is claimed is:

1. An oil bath boiler comprising:

a pressure vessel with a substantially non-volatile and fixed volume of oil partially filling said pressure vessel, a heat exchanger immersed in said oil within said vessel, a combustion source communicating with said heat exchanger wherein heat from said combustion source is transmitted to said oil by said heat exchanger, a steam outlet communicating with said pressure vessel in a region not filled by said oil, and at least one water injection unit having a water outlet immersed in said oil wherein water is injected directly into said oil and is transformed to steam which exists said steam outlet.

2. The oil bath boiler of claim 1 wherein said water injection unit comprises a high pressure pump, a check valve and a nozzel.

3. The oil bath boiler of claim 1 wherein said combustion source utilizes a conventional fuel for which the combustion is irregular.

4. The oil bath boiler of claim 1 comprising further an auxiliary component connected to said steam outlet which is operable by steam generated by said oil bath boiler.

5. The oil bath boiler of claim 4 comprising further a condenser connected to said auxiliary component for condensing steam utilized by said auxiliary component.

6. The oil bath boiler of claim 1 wherein said combustion source comprises a fire place.

7. The oil bath boiler of claim 1 wherein said heat exchanger comprises a plurality of vertical close end tubes rising up into said pressure vessel from said combustion source.

* * * * *